US005094212A

United States Patent [19]

Kawaguchi et al.

[11] Patent Number: 5,094,212

[45] Date of Patent: Mar. 10, 1992

[54] THROTTLE BODY ASSEMBLY

[75] Inventors: Yuji Kawaguchi; Tomio Aoi; Kiyohide Nagase; Yoshio Suzuki; Yasuhiro Toyoda; Toshihiro Kameda; Hiroshi Hashimoto; Isao Murakami; Akihiro Iwasaki, all of Saitama, Japan

[73] Assignee: Honda Giken Kogyo Kabushiki Kaisha, Tokyo, Japan

[21] Appl. No.: 500,656

[22] Filed: Mar. 28, 1990

[30] Foreign Application Priority Data

Mar. 28, 1989 [JP] Japan ..... 1-75781
Mar. 28, 1989 [JP] Japan ..... 1-75782
Mar. 28, 1989 [JP] Japan ..... 1-75783

[51] Int. Cl.[5] ..... F02M 51/00

[52] U.S. Cl. ..... 123/470; 123/585; 123/478; 123/509; 123/41.31; 123/472

[58] Field of Search ..... 123/472, 470, 494, 585, 123/491, 478, 198 C, 509, 497, 41.31, 468, 462, 339; 417/366; 261/DIG. 82

[56] References Cited

U.S. PATENT DOCUMENTS 3,969,044 7/1976 Fussner ..... 417/366
4,054,108 10/1977 Gill ..... 123/198 C
4,284,588 8/1981 Hallberg ..... 123/462
4,364,355 12/1982 Karino ..... 165/51
4,442,812 4/1984 Mizuno ..... 123/491
4,475,518 10/1984 Kashiwaya ..... 123/339
4,543,914 10/1985 Harris ..... 123/41.31
4,580,536 4/1986 Takao ..... 123/585
4,580,951 4/1986 Carleton et al. ..... 417/366
4,714,065 12/1987 Cascajosa ..... 123/497
4,724,812 2/1988 Akagi ..... 123/585
4,776,313 10/1988 Freismuth ..... 123/468
4,796,580 1/1989 Wakeman ..... 123/339
4,811,709 3/1989 Braun et al. ..... 123/41.31
4,940,035 7/1990 Waring ..... 123/497

FOREIGN PATENT DOCUMENTS 0065522 6/1978 Japan ..... 123/198 C
0098648 7/1980 Japan ..... 261/DIG. 82
58-122358 7/1983 Japan .
61-85543 5/1986 Japan .
0285249 11/1988 Japan ..... 123/339
2082252 3/1982 United Kingdom ..... 123/470

*Primary Examiner*—E. Rollins Cross
*Assistant Examiner*—Erick Solis
*Attorney, Agent, or Firm*—Skjerven, Morrill, MacPherson, Franklin & Friel

[57] ABSTRACT

A throttle body assembly for supplying a mixture of fuel and air to an intake port of an internal combustion engine, integrally incorporating a fuel injection valve, a fuel pump, a fuel supply passage defined in the throttle body and extending from the fuel pump to the fuel injection valve, and a fuel pressure control valve directly incorporated in the throttle body to control pressure of fuel in the fuel supply passage. Thus, there is no need to use an external tubing system for supplying and returning fuel to and from the fuel injection valve, and the throttle body assemby may be simplified in structure so as to facilitate the assembling and servicing of the throttle body assembly. Further, an electronic control unit and sensors associated with the control unit are both directly mounted on the throttle body so that wiring around the throttle body may be eliminated.

5 Claims, 7 Drawing Sheets

THROTTLE BODY ASSEMBLY

TECHNICAL FIELD

The present invention relates to a throttle body assembly for supplying a mixture of fuel and air to an internal combustion engine, and in particular to such a throttle body assembly which combines various accessory components integrally and advantageously into a single assembly.

BACKGROUND OF THE INVENTION

In a conventional electronically controlled internal combustion engine using a single-point fuel injection system, a fuel injection valve is mounted on a throttle body defining an intake bore controlled by a throttle valve. The amount of fuel injection is controlled by a control unit according to the load condition of the engine as determined by the opening angle of the throttle valve, intake negative pressure, intake temperature and so on as well as the rotational speed of the engine. A typical single point fuel injection system is disclosed in Japanese patent laid open publication No. 58-122358.

In such a conventional single-point fuel injection system, there are so many accessory parts associated with the throttle body that the surrounding of the throttle body tends to be extremely crowded. This complicates the assembling process of the fuel injection system, and impairs the facility of servicing the fuel injection system. In particular, the wiring for the fuel injection valve and various sensors and the piping for the fuel injection valve are two major sources of problems.

Additionally, such a throttle body is typically equipped with a by-pass air passage controlled by a by-pass air control valve for controlling a flow of by-pass air by-passing the throttle valve and obtaining a favorable idling condition of the engine, and this also contributes to the complexity of the structure surrounding the throttle valve. A typical by-pass air control system is disclosed in Japanese patent laid open application No. 61-85543.

BRIEF SUMMARY OF THE INVENTION

In view of such problems of the prior art, a primary object of the present invention is to provide a throttle body assembly which is easy to assemble.

A second object of the present invention is to provide a throttle body assembly which is economical to fabricate.

A third object of the present invention is to provide a throttle body assembly which offers a simplified arrangement for its accessory component parts.

These and other objects of the present invention can be accomplished by providing: a throttle body assembly for supplying a mixture of fuel and air to an intake port of an internal combustion engine, comprising: a throttle body defining an intake bore therein; a throttle valve provided in the throttle body to control flow of air through the intake bore; a fuel injection valve mounted on the throttle body with its nozzle end communicating with the intake bore; a fuel pump directly mounted on the throttle body; a fuel supply passage defined in the throttle body and extending from the fuel pump to the fuel injection valve; and a fuel pressure control valve directly incorporated in the throttle body to control pressure of fuel in the fuel supply passage. Preferably, a fuel return passage is also defined in the throttle body and extends from an outlet end of the fuel pressure control valve to a fuel outlet which advantageously passes through the interior of an electric motor associated with the fuel pump to achieve a cooling effect for the motor.

Thus, there is no need to use any external tubing system for supplying and returning fuel to and from the fuel injection valve, and the throttle body assembly may be simplified in structure so as to facilitate the assembly and servicing of the throttle body assembly. In particular, by conducting the fuel returned from the fuel injection valve to an electric motor for driving the fuel pump, the fuel may be utilized for cooling the motor.

By utilizing a by-pass air passage at least partly defined in the throttle body, and a by-pass air control valve directly mounted on the throttle body to control flow of air through the by-pass air passage, an even further simplification of the throttle body assembly can be accomplished. By providing a by-pass air control valve consisting of a solenoid valve near the valve shaft for the throttle valve, sticking of the valve shaft can be avoided even in cold weather condition by means of the heat generated by the by-pass air control solenoid valve. Preferably, the by-pass air passage may be defined by a hollow columnar member extending integrally from the throttle body and projecting into an air cleaner case at its free end, and a wall portion of the throttle body so that the by-pass air passage may extend from the air cleaner case to a flange end of the throttle body all the way through a part of the throttle valve integral therewith.

Such a throttle valve assembly requires a control unit and various sensors. According to a preferred embodiment of the present invention, an electronic control unit and sensors associated with the control unit are both directly mounted on the throttle body. The sensors may include an intake pressure sensor, a throttle valve opening angle sensor, and an intake temperature sensor. The intake temperature sensor may be directly mounted on the throttle body and project into an air cleaner case at its sensing end.

According to such an aspect of the present invention, wiring around the throttle body may be minimized, and the throttle body assembly may be simplified in structure so as to facilitate the assembling and servicing of the throttle body assembly even further.

BRIEF DESCRIPTION OF THE DRAWINGS

Now a preferred embodiment of the present invention is described in the following with reference to the appended drawings, in which.

DETAILED DESCRIPTION OF A PREFERRED EMBODIMENT

Figure 1:
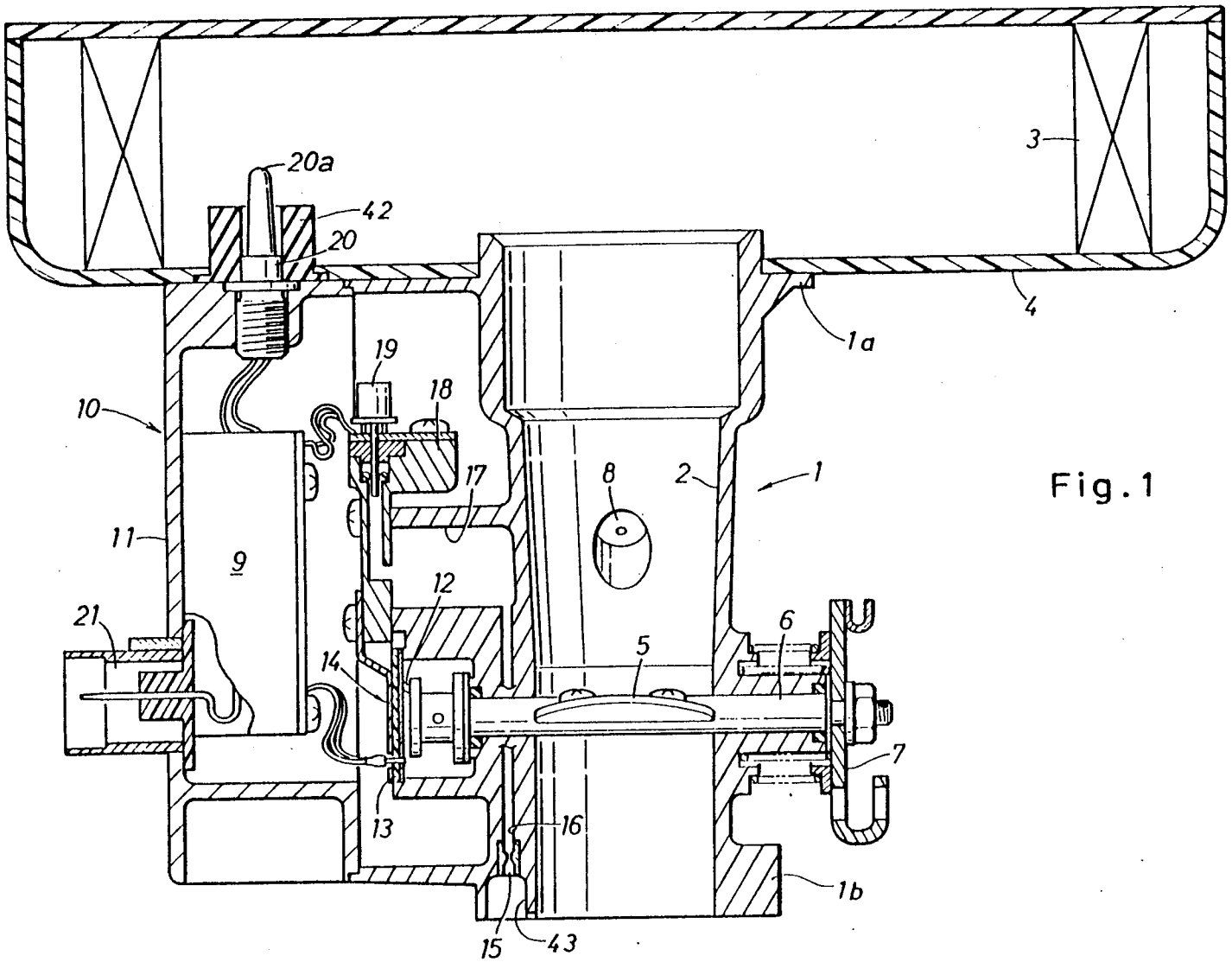
FIG. 1 is a vertical sectional view of a preferred embodiment of the throttle body assembly according to the present invention.

The preferred embodiment of the fuel supply system according to the present invention illustrated in the appended drawings comprises a throttle body 1 defining an intake bore 2. An air cleaner case 4 accommodating an air cleaner element 3 is mounted on this throttle body 1 at its upper end or an upstream end of the intake bore 2 provided with a flange 1*a*, and a throttle valve 5 is rotatably supported in a middle part of the intake bore 2 by means of a valve shaft 6 extending across the intake bore 2. An outer end of the valve shaft 6 extending out of the throttle body 1 carries a throttle drum 7, and a throttle wire not shown in the drawing is passed around the throttle drum 7 to open the throttle valve 5 as desired against a restoring force of a return spring.

A fuel injection valve 8 is passed through a part of the wall defining the intake bore 2 slightly upstream of the throttle valve 5 in an oblique fashion with its nozzle end communicated with the intake bore 2.

A chamber 17 is defined by an external wall surface of a part of the throttle body adjoining the other end of the valve shaft 6, and a casing 11 placed thereon. An electronic control unit 10, which is attached to an inner wall surface of the casing 11, includes a control circuit 9 which controls the operation of this fuel supply system as described hereinafter. This end of the valve shaft 6 carries a brush 12 which sweeps over the surface of a resistor board 13 mounted on an opposite wall so as to form a potentiometer or a throttle valve opening angle sensor 14 whose resistive value changes in relation with the opening angle of the throttle valve 5.

Figure 7:
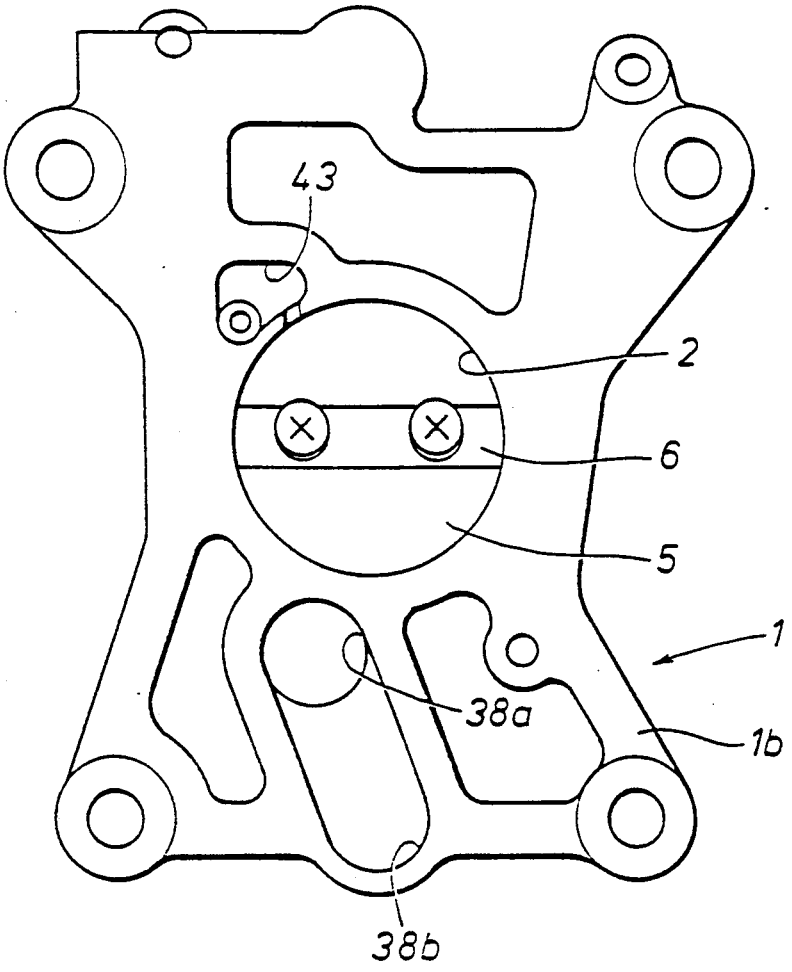
FIG. 7 is a bottom end view of the throttle body assembly.

The chamber 17 is substantially enclosed, and a passage 16 having an orifice 15 extends from a part of the intake bore 2 downstream of the throttle valve 5 to the interior of the chamber 17. The inner end of this passage 16 is however closed by a pressure sensor bracket 18 which carries a negative pressure sensor 19 for detecting a negative pressure level in the chamber 17. The other end of the passage 16 communicates with the intake bore 2 via a cavity 43 provided in an end surface of a lower or an engine end flange 1*b* of the throttle body 1 (FIG. 7).

A temperature sensor 20 is passed through the upper wall of the casing 11 which juxtaposes a bottom wall of the air cleaner case 4, and its sensing head 20*a* projects into the interior of the air cleaner case 4 via an elastomer seal ring 42 in order to detect the temperature of the intake air.

Figure 4:
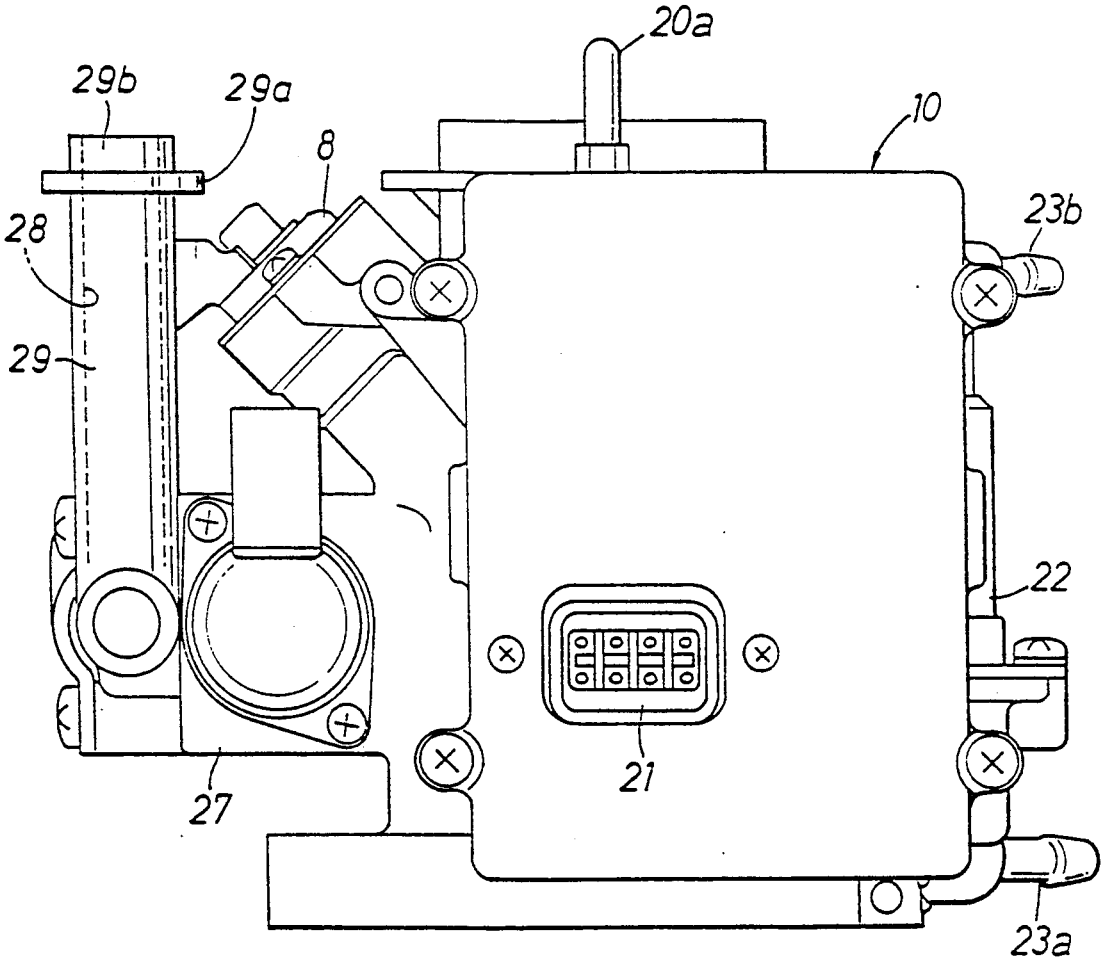
FIG. 4 is a rear view of the throttle body assembly without the air cleaner case.

The control circuit 9 is connected to an external main control unit (not shown in the drawings) via a connector 21 passed through the side wall of the casing 11 (FIG. 4).

Figure 2:
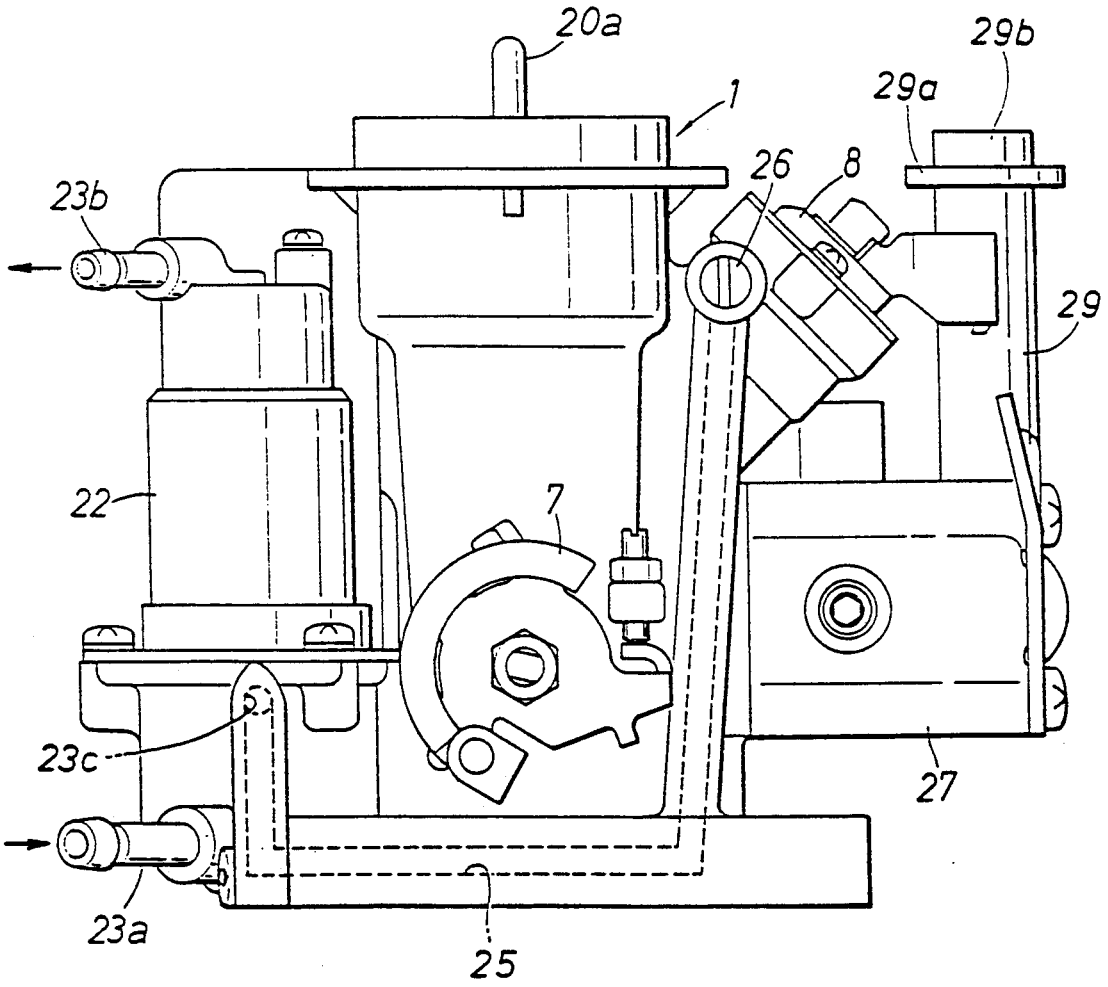
FIG. 2 is a front view of the throttle body assembly without the air cleaner case.
Figure 5:
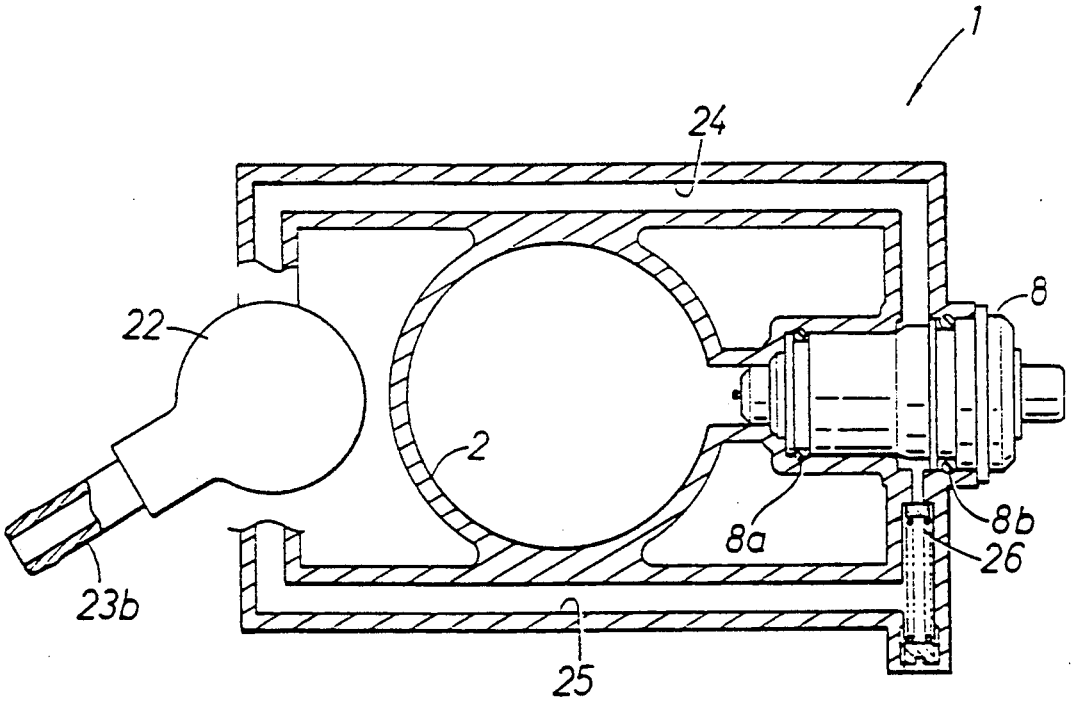
FIG. 5 is a cross sectional view of the throttle body assembly.

Referring to FIG. 2, a side part of the throttle body 1 facing away from the fuel injection valve 8 carries a fuel pump 22 which may consists of a known electric motor powered volumetric pump. Fuel is drawn from a fuel tank not shown in the drawings via a lower inlet 23*a* of this fuel pump 22 and is supplied to the fuel injection valve 8 via a fuel supply passage 24 defined inside the side wall of the throttle body 1 as show in FIG. 5. Referring to FIG. 5, a terminal end of this fuel supply passage 24 is formed into an annular passage surrounding the fuel injection valve 8 and sealed off by a pair of O-rings 8*a* and 8*b* interposed between the fuel injection valve 8 and the bore of the throttle body 1 receiving the same on either side of this annular passage. Referring to FIGS. 2 and 5, any excess fuel which is not used by the fuel injection valve 8 passes through a relief valve 26 and a fuel return passage 25 both defined in the side wall of the throttle body 1 and the lower flange 1*b*, and is returned to the fuel tank via an upper outlet 23*b* after passing through inside the electric motor of the fuel pump 22 from a port communicating with the interior of the motor.

Thus, the pressure of the fuel supplied to the fuel injection valve 8 is determined by the set pressure of the relief valve 26. Further, by directly mounting the fuel pump 22 on the throttle body 1 and defining the passages for supplying and returning fuel to and from the fuel injection valve 8 in the surrounding wall of the throttle body, tubing around the throttle body can be totally eliminated, and not only the assembling process is simplified but also the problem of fuel leakage is virtually eliminated. Also, the fuel returning from the fuel injection valve 8 to the fuel tank may be utilized for cooling the electric motor for the fuel pump 22.

A by-pass air control valve 27 consisting of a solenoid valve is attached to a casing 32 integrally formed in the throttle body 1 immediately below the fuel injection valve 8. The by-pass air control valve 27 controls flow of by-pass air by-passing the throttle valve 5, and aids the control of the rotational speed of the engine during idling.

Figure 3:
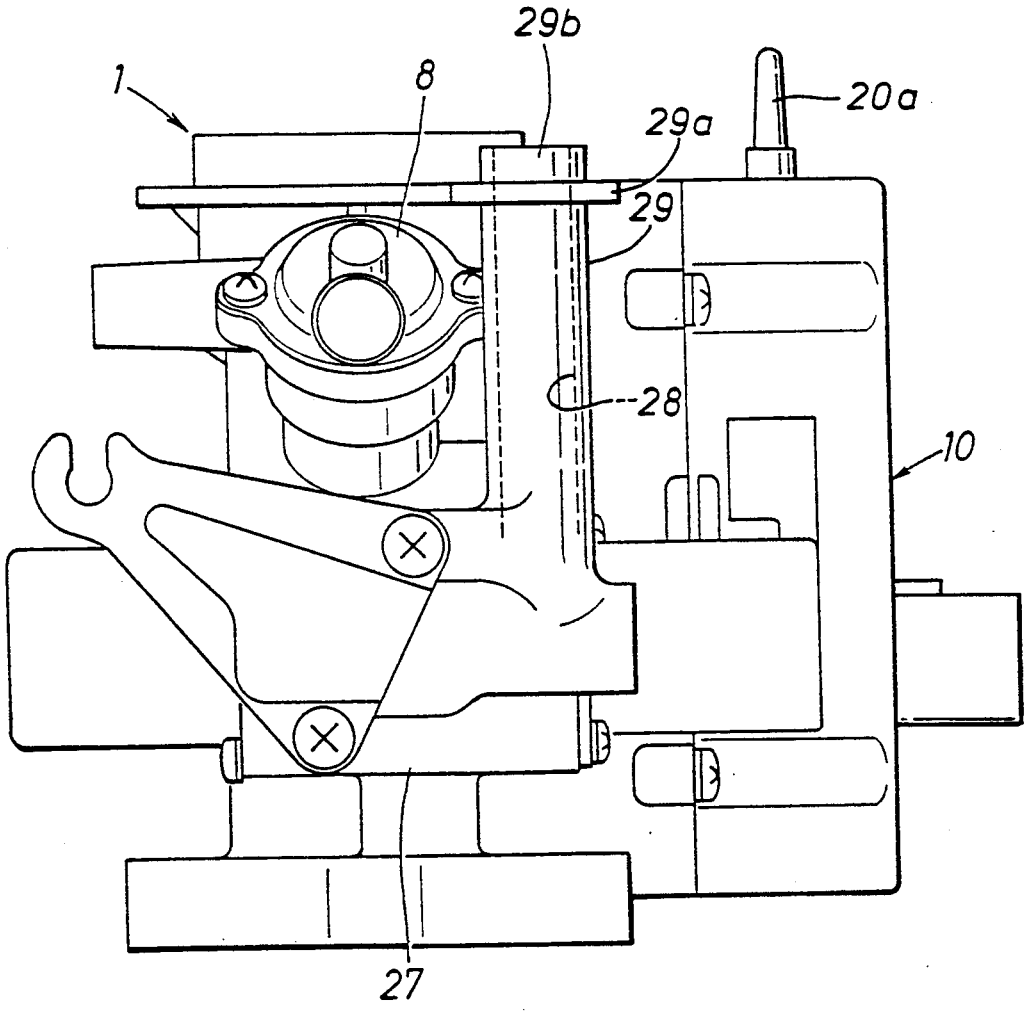
FIG. 3 is a side view of the throttle body assembly without the air cleaner case.
Figure 6:
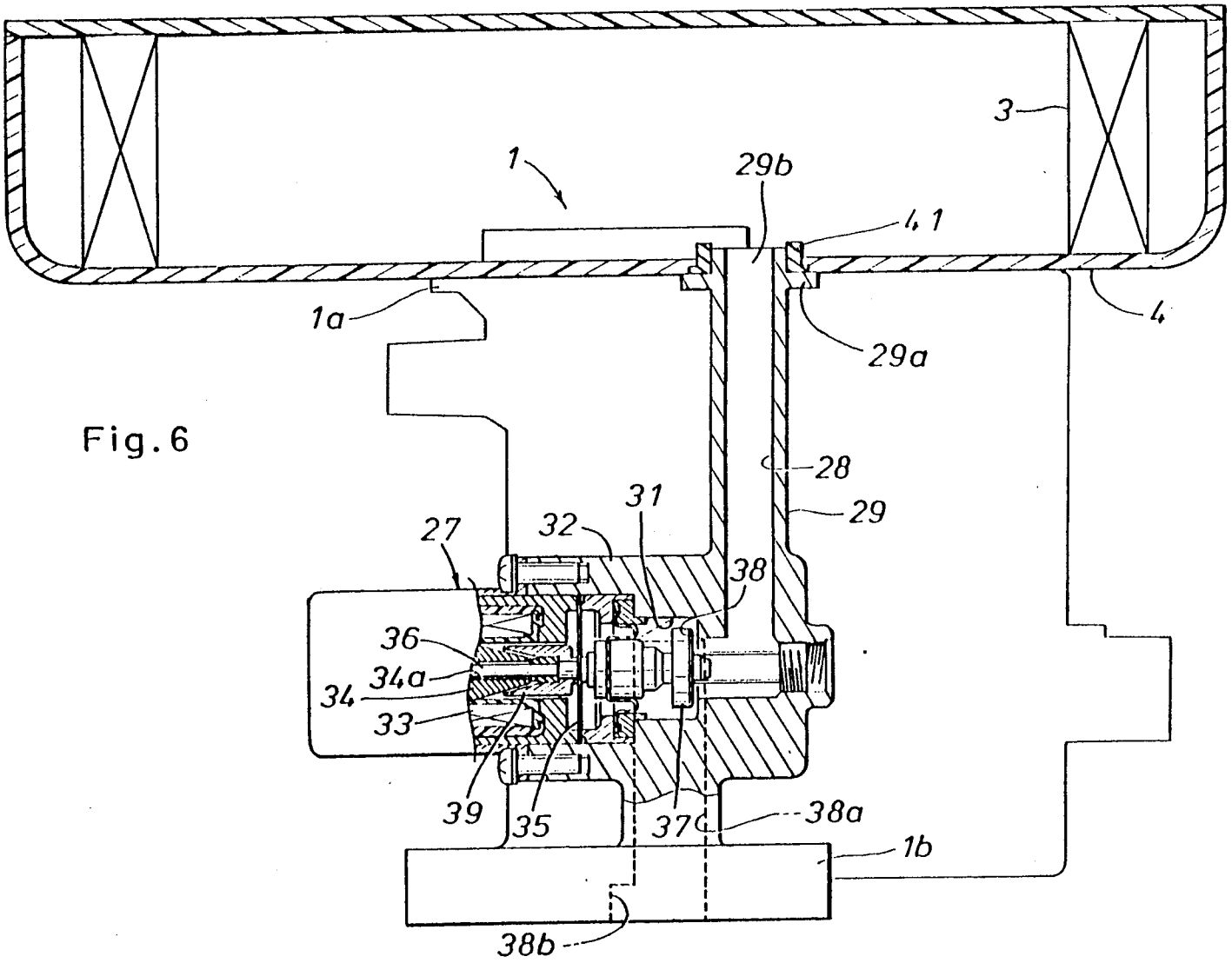
FIG. 6 is another vertical sectional view showing the by-pass air control valve.

As best shown in FIGS. 2, 3 and 6, a hollow column 29 extends integrally upwards from the casing 32, and internally defines a passage 28 communicating an internal valve chamber 31 inside the casing 32 with the interior of the air cleaner case 4 by way of a free end 29*b* of the hollow column 29 which projects into the interior of the air cleaner case 4 from the bottom wall of the air cleaner case 4 with a flange 29*a* of the hollow column 29 abutting the lower surface of the air cleaner case 4 and an elastomer seal ring 41 ensuring an air-tightness of the coupling between the hollow column 29 and the air cleaner case 4. The valve chamber 31 also communicates with a part of the intake bore 2 downstream of the throttle valve 5 via a passage 38*a* defined in the throttle body 1, and a cavity 38*a* defined in the lower flange 1*b* of the throttle body 1 (FIG. 7).

The by-pass air control valve 27 comprises a coil winding 33, a valve shaft 36 passed through a central bore 34*a* of a core 34 of the coil winding 33, and a discus valve element 37 attached to a free end of the valve shaft 36. By selectively engaging this valve element 37 with a valve seat 38 defined at an opening in the casing 32 communicating with the by-pass air passage 28, the communication between the by-pass air passages 28 and 38*a* can be selectively shut off.

Such a movement of the valve element 37 can be accomplished by supplying electric current to the coil winding 33 and attracting an armature 39 integrally formed with the valve shaft 36 towards the core 34 of the coil winding 33 against the spring force of a diaphragm spring 35 which normally urges the valve element 37 to its closed position. By appropriately controlling the energized state of the coil winding 33, it is possible to control the opening degree of the valve element 37, and a desired degree of communication between the by-pass air passages 28 and 38*a* can be accomplished.

Since the by-pass air control solenoid valve 27 is attached directly to the throttle body 1, in particular near the valve shaft 6 of the throttle valve 5, heat generated by the by-pass air control valve 27 can prevent the sticking of the valve shaft 6 due to freezing in a cold weather condition. Also, since the by-pass air control valve 27 may be placed away from the engine itself and directly upon the throttle body 1 which is favorably cooled by the evaporation of fuel within the throttle body 1, the overheating of the by-pass air control valve 27 can be avoided.

According to an electronically controlled fuel supply system, the fuel injection valve is controlled by a control unit according to outputs of sensors for detecting intake negative pressure, a throttle valve opening angle, and intake temperature. Therefore, according to such a conventional arrangement, it was necessary to connect the control unit with the various sensors and fuel injection valves by electric wires in addition to the need to connect the fuel injection valve to a fuel pump with a tube. Therefore, its structure was inevitably complex, and its assembling process required complicated work.

The present embodiment eliminates such a problem as various component parts such as the fuel pump 22 and the by-pass air control valve 27 are integrally attached to the throttle body 1, and the sensors such as the throttle valve opening angle sensor 14, the negative pressure sensor 19 and the temperature sensor 20 are integrally attached to the throttle body 1 itself or the casing 11 for the control circuit 9 which is also integrally attached to the throttle body 1.

Thus, since various component parts for controlling the condition of the engine intake are integrally mounted on the throttle body and they may be consolidated into a single sub assembly, the manufacturing process is simplified, the cost for the assembly work is reduced, and the structure surrounding the throttle body is simplified.

What we claim is:

1. A throttle body assembly for supplying a mixture of fuel and air to an intake port of an internal combustion engine, comprising:

a throttle body defining an intake bore therein;

a throttle valve provided in said throttle body to control flow of air through said intake bore;

a fuel injection valve mounted on said throttle body with its nozzle end communicating with said intake bore;

a fuel pump directly mounted on said throttle body;

a fuel supply passage defined in said throttle body and extending from said fuel pump to said fuel injection valve;

a fuel pressure control valve directly incorporated in said throttle body to control pressure of fuel in said fuel supply passage;

a fuel return passage defined in said throttle body and extending from an outlet end of said fuel pressure control valve to a fuel outlet, a fuel outlet end of said fuel return passage passing through an interior of an electric motor associated with said fuel pump; and an electronic control unit and at least one sensor associated with said control unit both directly mounted on said throttle body.

2. A throttle body assembly according to claim 1, further comprising a by-pass air passage by-passing said throttle valve, said by-pass air passage being defined at least partly by a hollow columnar member extending integrally from said throttle body and connecting into an air cleaner case at its free end; and a by-pass air control valve directly mounted on said throttle body to control flow of air through said by-pass air passage.

3. A throttle body assembly according to claim 2, wherein another part of said by-pass air passage is defined in a wall portion of said throttle body and extends between said by-pass air control valve and a cavity defined in an engine end flange of said throttle body.

4. A throttle body assembly according to claim 1, wherein a plurality of sensors are directly mounted on said throttle body, and said sensors include an intake pressure sensor, and a throttle valve opening angle sensor.

5. A throttle body assembly according to claim 4, wherein said sensors further include an intake temperature sensor which is directly mounted on said throttle body and projects into an air cleaner case attached to said throttle body at its sensing end.

* * * * *